US006863587B1

(12) United States Patent
Bennett

(10) Patent No.: US 6,863,587 B1
(45) Date of Patent: Mar. 8, 2005

(54) ANIMATED WORKOUT SIMULATING FIGURINE

(76) Inventor: Beverly L. Bennett, 17596 Meadowood Ave., Lathrup Village, MI (US) 48076

( * ) Notice: Subject to any disclaimer, the term of this patent is extended or adjusted under 35 U.S.C. 154(b) by 3 days.

(21) Appl. No.: 10/388,845

(22) Filed: Mar. 14, 2003

(51) Int. Cl.[7] ..... A63H 3/28
(52) U.S. Cl. ..... 446/297; 446/268; 446/484
(58) Field of Search ..... 446/484, 331, 446/298, 297, 299, 330, 354, 353, 352, 358

(56) References Cited

U.S. PATENT DOCUMENTS

| | | | | | |
|---|---|---|---|---|---|
| 1,430,811 | A | * | 10/1922 | Johnson et al. | 446/302 |
| 3,164,924 | A | * | 1/1965 | Iwaya et al. | 446/143 |
| 3,643,374 | A | * | 2/1972 | Gunther et al. | 446/358 |
| 3,722,135 | A | | 3/1973 | Jacobson | |
| 3,916,562 | A | * | 11/1975 | Burkhart | 446/143 |
| 3,977,122 | A | * | 8/1976 | Meyer et al. | 446/268 |
| 4,027,425 | A | * | 6/1977 | Morrison et al. | 446/299 |
| 4,654,659 | A | | 3/1987 | Kubo | |
| 4,676,764 | A | * | 6/1987 | Yeu | 446/298 |
| 4,775,352 | A | | 10/1988 | Curran et al. | |
| 4,824,416 | A | * | 4/1989 | Chun-Hoi et al. | 446/298 |
| 4,846,693 | A | | 7/1989 | Baer | |
| 4,889,027 | A | * | 12/1989 | Yokoi | 84/635 |
| 4,923,428 | A | | 5/1990 | Curran | |
| 4,934,981 | A | * | 6/1990 | Stulbach | 446/323 |
| 5,013,276 | A | * | 5/1991 | Garfinkel | 446/354 |
| 5,176,560 | A | * | 1/1993 | Wetherell et al. | 446/175 |
| 5,403,223 | A | * | 4/1995 | Gaulkin et al. | 446/73 |
| 5,735,726 | A | * | 4/1998 | Cohen | 446/298 |
| D408,873 | S | | 4/1999 | Adams | |
| 6,155,904 | A | * | 12/2000 | Spector | 446/320 |

FOREIGN PATENT DOCUMENTS

| | | | | |
|---|---|---|---|---|
| JP | 05184728 | A | * 7/1993 | A63H/30/02 |

* cited by examiner

*Primary Examiner*—Derris H. Banks
*Assistant Examiner*—Urszula M Cegielnik

(57) ABSTRACT

An animated workout simulating figurine for simulating a workout routine as an example that can be followed by a user. The animated workout simulating figurine includes a jointed figurine that performs a workout routine that may then be followed as an example. Optionally, the animated figurine may have multiple selectable pre-programmed routines for variety or working particular muscle groups.

10 Claims, 2 Drawing Sheets

ANIMATED WORKOUT SIMULATING FIGURINE

BACKGROUND OF THE INVENTION

1. Field of the Invention

The present invention relates to animated figurines and more particularly pertains to a new animated workout simulating figurine for simulating a workout routine as an example that can be followed by a user.

2. Description of the Prior Art

The use of animated figurines is known in the prior art. U.S. Pat. No. 4,923,428 describes a device that is interactive using a microcontroller to control movement of a human form toy. Another type of animated figurine is U.S. Pat. No. 4,775,352 disclosing a talking doll with animated features. U.S. Pat. No. 4,846,693 discloses an entertainment system that includes an animated figurine controllable by a user.

While these devices fulfill their respective, particular objectives and requirements, the need remains for an animated device that provides a workout routine that can be followed as an example of proper technique and balanced combinations of particular exercises.

SUMMARY OF THE INVENTION

The present invention meets the needs presented above by providing an animated figurine that is jointed and controlled by microcontroller to perform pre-programmed workout routines.

Still yet another object of the present invention is to provide a new animated workout simulating figurine that has audio playing capability to match the workout routine.

To this end, the present invention generally comprises a jointed figurine that performs a workout routine that may then be followed as an example. Optionally, the animated figurine may have multiple selectable pre-programmed routines for variety or working particular muscle groups.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
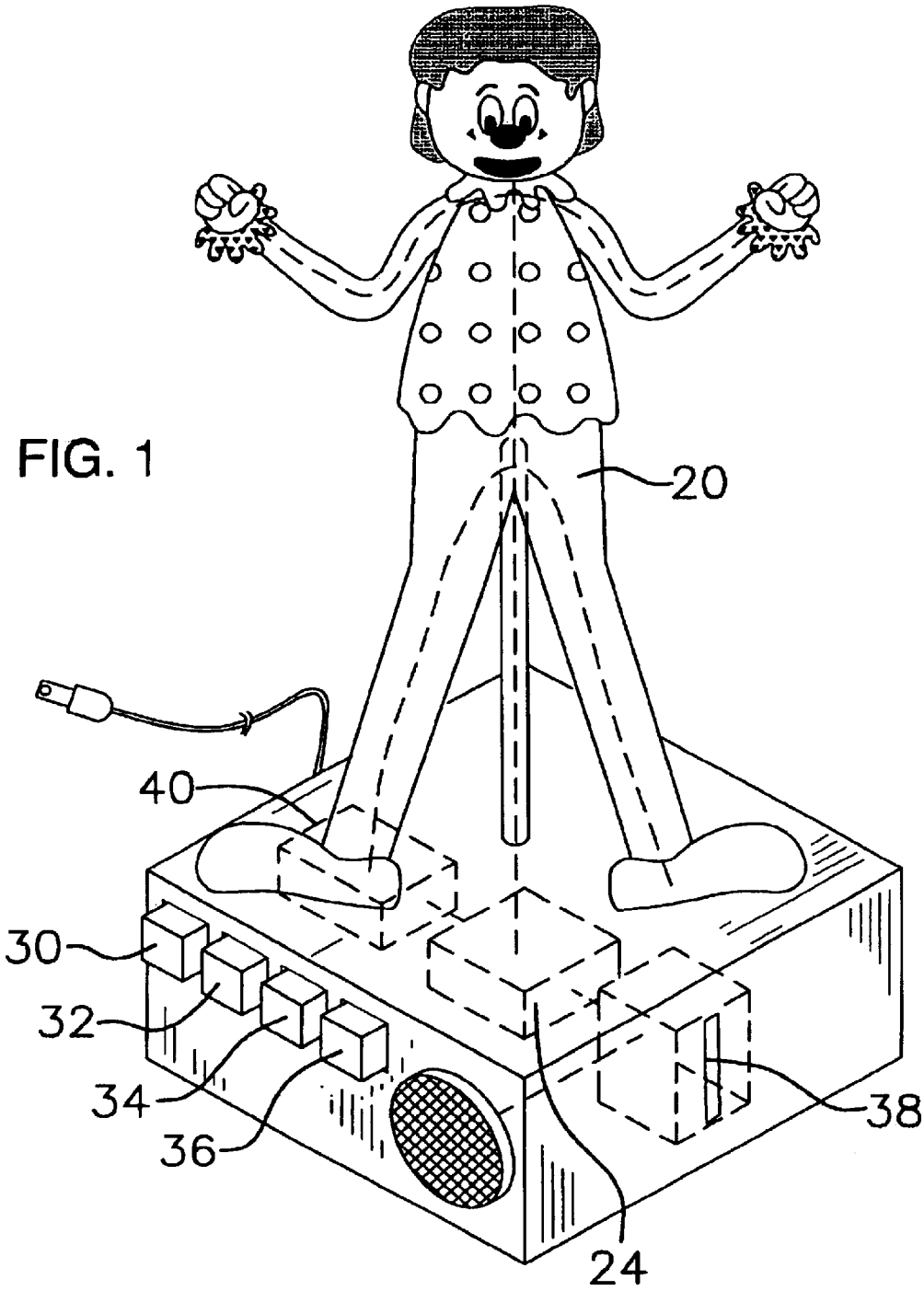
FIG. 1 is a perspective view of a new animated workout simulating figurine according to the present invention.
Figure 2:
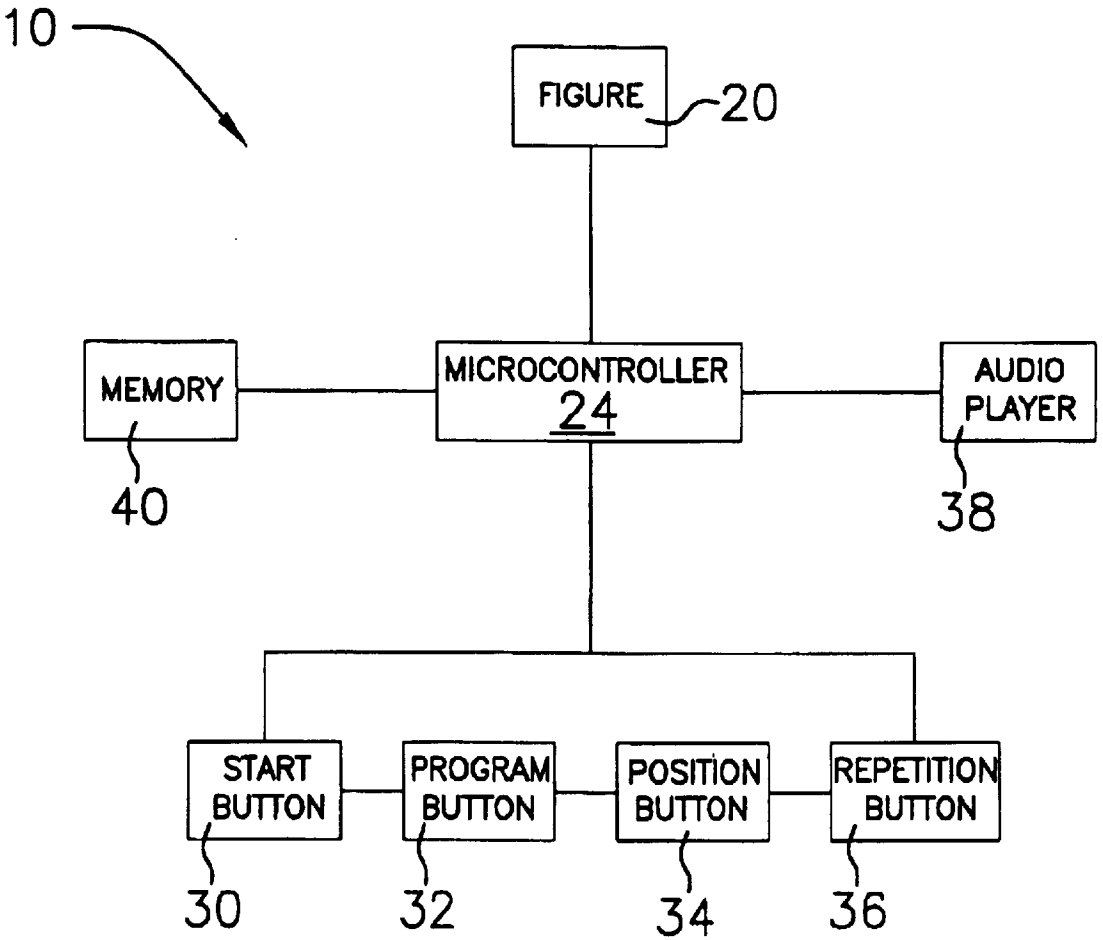
FIG. 2 is a schematic of the present invention.

With reference now to the drawings, and in particular to FIGS. 1 through 2 thereof, a new animated workout simulating figurine embodying the principles and concepts of the present invention and generally designated by the reference numeral 10 will be described.

As best illustrated in FIGS. 1 through 2, the animated workout simulating figurine 10 generally comprises an automated figurine 20 that is jointed such that the figurine 20 is movable into exercise positions. The automation is provided using currently known technology and robotics. A microcontroller 24 is operationally coupled to the automated figurine 20 for positioning the figurine 20 into a series of pre-determined positions corresponding to a workout routine. Thus, a person can use the figurine as a guide or inspirational tool during exercise. Additionally, the movements of the figurine should be programmed to be sufficiently precise to demonstrate proper exercise form for each particular exercise movement.

A base 26 is coupled to the automated figurine 20. A plurality of buttons 28 are positioned on the base 26. The buttons 28 are operationally coupled to the microcontroller for programming the microcontroller.

The plurality of buttons 28 includes a start button 30 coupled to the base 26. The start button 30 is operationally coupled to the microcontroller 24 to initiate the series of pre-determined positions upon depression of the start button 30.

The buttons 28 are most preferably designed as follows to provide simplified programming of a customized exercise workout routine. A program button 32 is coupled to the base 26 and a position button 34 is also coupled to the base 26. The position button 34 is operationally coupled to the microcontroller 24 for successively positioning the figurine 20 in each of the pre-determined positions upon successive pressing of the position button 34. The program button 32 is operationally coupled to the microcontroller 24 for programming a current position of the figurine 20 into a programmable series of exercise positions. The figurine is positioned in the desired position using the position button, the program button is pressed to introduce that position into the workout routine, the figurine is positioned in the next desired position using the position button, the program button is pressed again to place the new position into the workout routine, and so on. Thus, the microcontroller 24 is programmed to use a customized series of exercise positions using the position button 34 and the program button 32.

A repetition number button 36 is also coupled to the base 26. The repetition number button 36 is operationally coupled to the microcontroller 24 for inputting a number of times the figurine 20 is to be placed into a programmed exercise position to simulate repetitions of an exercise. For example, to program ten knee bends, the figurine is positioned in the knee bend position using the position button, the program button is pressed, and then the repetition number button is pressed until the desired number of repetitions is achieved. Alternately, the position may be determined, then the number of repetitions, and then the program button is pressed to set the exercise and number of repetitions in the workout routine.

A music playback mechanism 38 is coupled to the base 26 to provide additional motivation and/or enjoyment for the exerciser.

Storage memory 40 is operationally coupled to the microcontroller 24 for storing a plurality of pre-programmed workout routines for the figurine 20 to simulate. Thus, routines may be saved and re-used multiple times without having to reprogram the microcontroller 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An animated workout simulating figurine assembly comprising:

an automated figurine said figurine being jointed such that said figurine is movable into exercise positions;

a microcontroller operationally coupled to said automated figurine for positioning said figurine into a series of pre-determined positions corresponding to a workout routine;

a base coupled to said automated figurine;

a plurality of buttons positioned on said base, said buttons being operationally coupled to said microcontroller for programming said microcontroller; and a music playback mechanism coupled to said base;

a program button coupled to said base;

a position button coupled to said base;

wherein said position button is operationally coupled to said microcontroller for successively positioning said figurine in each of said pre-determined positions upon successive pressing of said position button;

said program button being operationally coupled to said microcontroller for programming a current position of said figurine into a programmable series of exercise positions whereby-said microcontroller is programmable to use a customizable series of exercise positions using said position button and said program button; and a repetition number button coupled to said bases said repetition number button being operationally coupled to said microcontroller for inputting a number of times said figurine is be placed into a programmed exercise position to simulate repetition of an exercise.

2. The animated workout simulating figurine assembly of claim 1, further comprising:

said plurality of buttons including a start button coupled to said base, said start button being operationally coupled to said microcontroller to initiate said series of pre-determined positions upon depression of said start button.

3. The animated workout simulating figurine of claim 1, further comprising:

storage memory operationally coupled to said microcontroller for storing a plurality of pre-programmed workout routines for said figurine to simulate.

4. An animated workout simulating figurine assembly comprising:

an automated figurine said figurine being jointed such that said figurine is movable into exercise positions;

a microcontroller operationally coupled to said automated figurine for positioning said figurine into a series of pre-determined positions corresponding to a workout routine;

a base coupled to said automated figurine;

a plurality of buttons positioned on said base, said buttons being operationally coupled to said microcontroller for programming said microcontroller;

said plurality of buttons including a start button coupled to said base, said start button being operationally coupled to said microcontroller to initiate said series of pre-determined positions upon depression of said start button;

a program button coupled to said base;

a position button coupled to said base;

wherein said position button is operationally coupled to said microcontroller for successively positioning said figurine in each of said pre-determined positions upon successive pressing of said position button;

said program button being operationally coupled to said microcontroller for programming a current position of said figurine into a programmable series of exercise positions whereby said microcontroller is programmable to use a customizable series of exercise positions using said position button and said program button;

a repetition number button coupled to said base, said repetition number button being operationally coupled to said microcontroller for inputting a number of times said figurine is to be placed into a programmed exercise position to simulate repetitions of an exercise;

a music playback mechanism coupled to said base; and storage memory operationally coupled to said microcontroller for storing a plurality of pre-programmed workout routines for said figurine to simulate.

5. An animated workout simulating figurine assembly comprising:

an automated figurine said figurine being jointed such that said figurine is movable into exercise positions;

a microcontroller operationally coupled to said automated figurine for positioning said figurine into a series of predetermined positions corresponding to a workout routine;

a base coupled to said automated figurine a plurality of buttons positioned on said base, said buttons being operationally coupled to said microcontroller of programming said microcontroller;

a music playback mechanism coupled to said base; and wherein said microcontroller positions said figurine independently of music playback mechanism.

6. The animated workout simulating figurine assembly of claim 5, further comprising:

said plurality of buttons including a start button coupled to said base, said start button being operationally coupled to said microcontroller to initiate said series of pre-determined positions upon depression of said start button.

7. The animated workout simulating figurine of claim 5, further comprising:

a program button coupled to said base;

a position button coupled to said base;

wherein said position button is operationally coupled to said microcontroller for successively positioning said figurine in each of said pre-determined positions upon successive pressing of said position button; and said program button being operationally coupled to said microcontroller for programming a current position of said figurine into a programmable series of exercise positions whereby said microcontroller is programmable to use a customizable series of exercise positions using said position button and said program button.

8. The animated workout simulating figurine of claim 7, further comprising:

a repetition number button coupled to said base, said repetition number button being operationally coupled to said microcontroller for inputting a number of times said figurine is to be placed into a programmed exercise position to simulate repetitions of an exercise.

9. The animated workout simulating figurine of claim 5, further comprising:

storage memory operationally coupled to said microcontroller for storing a plurality of per-programmed workout routines for said figurine to simulate.

10. The animated workout simulating figurine assembly of claim 5, further comprising:

said plurality of buttons including a start button coupled to said base, said start button being operationally coupled to said microcontroller to initiate said series of pre-determined positions upon depression of said start button;

a program button coupled to said base;

a position button coupled to said base;

wherein said position button is operationally coupled to said microcontroller for successively positioning said figurine in each of said pre-determined positions upon successive pressing of said position button; said program button being operationally coupled to said microcontroller for programming a current position of said figurine into a programmable series of exercise positions whereby said microcontroller is programmable to use a customizable series of exercise positions using said position button and said program button;

a repetition number button coupled to said base, said repetition number button being operationally coupled to said microcontroller for inputting a number of times said figurine is to be placed into a programmed exercise positions to simulate repetitions of an exercise; and storage memory operationally coupled to said microcontroller for storing a plurality of pre-programmed workout routines for said figurine to simulate.

* * * * *